United States Patent [19]

Anthony

[11] Patent Number: 5,031,898

[45] Date of Patent: Jul. 16, 1991

[54] AMBULATORY LUMBAR TRACTION DEVICE

[76] Inventor: Dennis L. Anthony, 3805 Stetson, Lawrence, Kans. 66049

[21] Appl. No.: 421,674

[22] Filed: Oct. 16, 1989

[51] Int. Cl.[5] ..... A63B 1/00; A61H 1/02

[52] U.S. Cl. ..... 272/70; 128/75; 272/97

[58] Field of Search ..... 272/70, 130, 97, 93, 272/145, 69, 144, 134, 71; 128/25 R, 75, 78, 57

[56] References Cited

U.S. PATENT DOCUMENTS

| | | | |
|---|---|---|---|
| 2,623,518 | 12/1952 | Vaquette | 128/75 |
| 4,781,372 | 11/1988 | McCormack | 272/97 |
| 4,951,654 | 8/1990 | Gambale et al. | 128/75 |

FOREIGN PATENT DOCUMENTS

| | | | |
|---|---|---|---|
| 0955963 | 9/1982 | U.S.S.R. | 272/130 |

*Primary Examiner*—Stephen R. Crow

*Attorney, Agent, or Firm*—Hovey, Williams, Timmons & Collins

[57] ABSTRACT

An ambulatory lumbar traction device is provided for use by a patient experiencing lumbar discomfort whereby the patient may selectively apply traction to the lumbar region. The device hereof permits the patient to gradually apply lumbar traction without the need to have an attendant present, while at the same time exercising the paraspinal region by permitting pivoting movement of the hips and reciprocal movement of the legs. The device preferably includes an elevated frame mounting a movable sled for supporting the torso of the patient. An elastic belt extends around the back of the patient for applying traction to the lumbar region as the sled is advanced along the frame. A pelvic abutment pad is pivotally mounted to the frame to permit the hips of the patient to move, and a track carrying a pair of pedals enables the patient to simulate walking during traction.

15 Claims, 3 Drawing Sheets

10
16
60
54
62
64
56
66
14
58
52
22
68
92
50
18
110
48
46
42
38
40
44
34
32
30
36
28
24
26
104
20
102
106
108
112
12

AMBULATORY LUMBAR TRACTION DEVICE

BACKGROUND OF THE INVENTION

1. Field of the Invention

This invention relates to an apparatus especially useful in enabling self-treatment of a patient experiencing lumbar discomfort by enabling the patient to apply traction to the lumbar region while enabling him or her to simulate normal walking on an ambulatory track without imposing compression on the spine The apparatus hereof allows the lumbar spine to extend with traction and move with flexion, extension and rotational movement at the same time. More particularly, it is concerned with an ambulatory traction device which permits the patient, by the use of a selectively operated drive mechanism and a frame-mounted sled, to maintain positive control over the amount of traction applied while allowing movement of the hips relative to the lumbar spine in all ranges of motion to increase the normal bio-mechanical function of the lumbar spine in a prone spinal position, thereby strengthening supportive tissues surrounding the lumbar disc and slowing degenerative processes of the spinal joint tissue.

2. Description of the Prior Art

The healing arts have long recognized the benefits of lumbar traction to decrease compression of the spinal and paraspinal tissue which causes pain and discomfort to those afflicted with lumbar disfunction. In particular, a wide variety of lumbar traction units have heretofore been employed in order to treat conditions associated with spinal discomfort such as degenerative joint disease, spinal bio-mechanical disfunction, lack of range of motion, disc herniation, nerve-root compression and spinal muscle weakness.

Many such units consist of the patient supine on a table with a belt placed around the lower thoracic spine and a belt applied to the lower lumbar spine and hips. Motorized (static or intersegmenal) pulling force is applied to the belts to separate the distance between the two belts, thus tractioning or pulling apart the vertebrae and spinal tissue of the patient's lumbar spine.

Two medical problems are associated with this traditional treatment of the lumbar spine region using horizontal traction, both of which can mitigate against rapid cure. The first problem is the patient's difficult in getting off of the traction machine after treatment. Since the patient is already in a completely horizontal position, the injured muscles have to lift the individual up and are frequently reinjured. The second problem is that although horizontal traction pulls on the discs in paraspinal tissue (which includes ligaments, tendons and muscle), opening up the inner vertebral distances, it immobilizes the patient. The immobilized patient is unable to exercise or receive manipulation that could strengthen or rehibilitate paraspinal tissue and thus prevent future injuries. In addition, this form of traction is not patient controlled for comfort or discomfort and could cause stress to spinal tissue. The need for the presence of a therapist to administer this treatment increases the cost to the patient and therefore limits its use with indigent patients.

Another type of unit consists of a rigid belt attached to the lower thoracic spine of the patient and another rigid belt attached to the lower lumbar spine and hips. An adjustable expansion device is placed between the two belts, theoretically placing the area therebetween in traction. The patient is then instructed to walk around for ambulatory movement outside of the restricted belt area. Unfortunately, this does not allow for ambulatory in the restricted lumbar spinal region, and moreover may place additional compressive force on the patient's lower spine and hips.

Thus, there is a need for a lumbar traction device which is patient controlled. The availability of the patient to control the treatment is important in preventing discomfort to the patient, reducing overall cost, and relieving the patient of anxiety associated with losing control over the amount of traction being applied.

Additionally, there has been recognized a need for a lumbar traction device which enables the patient to relieve compression on the spinal and pelvic area without the need to place the entire body in a prone or supine position. By avoiding a complete prone or supine position, the patient may thus avoid reinjury to the lumbar spinal region by using the other muscles to mount and dismount the treatment apparatus.

Yet further, a need has been recognized for an effective lumbar traction device which enables the patient to employ an ambulatory motion to exercise and strengthen muscles, tendons and ligaments in the paraspinal region without placing the lower back and hip region in compression, or requiring ungainly and uncomfortable harnesses. Such a device would desirably enable the patient to control the amount of traction employed, the amount of ambulatory movement in the pelvic region, and the length of time the treatment will be conducted.

SUMMARY OF THE INVENTION

The problems outlined above are in large measure solved by the ambulatory lumbar traction device in accordance with the present invention. That is to say, the traction device hereof is patient-controlled, easy to mount and dismount, and enables the patient to employ an ambulatory motion simultaneously with traction of the restricted lumbar spinal region.

The ambulatory lumbar traction device in accordance with the present invention broadly includes an elevated frame mounting a movable sled thereon. The sled is adapted to support the torso region of the patient and is provided with a belt or other coupling device for binding the patient to the sled during traction. The device also includes a drive mechanism which is preferably continuously adjustable throughout the range of extension and hand-powered in order that the patient may precisely control the amount of traction during all phases of the therapy session. Preferably, the device includes a pivotally mounted abutment pad for engagement with the pelvic region of the patient, whereby movement of the sled carrying the patient's torso will be opposed by the abutment pad, placing the lumbar region in traction. The abutment member is pivotally mounted to the frame in order to permit normal ambulatory movement of the lumbar disc and spinal tissue during the traction process.

Additionally, the lumbar traction device hereof includes a pair of pedals on a platform assembly on which the patient may stand prior to mounting the machine. When the patient is prepared to use the device hereof, he or she may bend at the waist, with the torso region supported by the sled and the feet remaining on movable pedals. Preferably, the pedals are interconnected whereby movement of one pedal forward is accompanied by movement of the other pedal in a rearward direction. Thus, ambulatory motion of the pelvic region may be simulated without placing it in compression.

In particularly preferred forms, the frame and sled are pivotally mounted to a support member, whereby the height of the abutment pad may be raised and lowered to accommodate patients of different heights. Thereby, the patient will not ordinarily be discomforted by improper positioning of the abutment member when mounting or using the device hereof.

DETAILED DESCRIPTION OF THE DRAWING

Figures 1, 2:
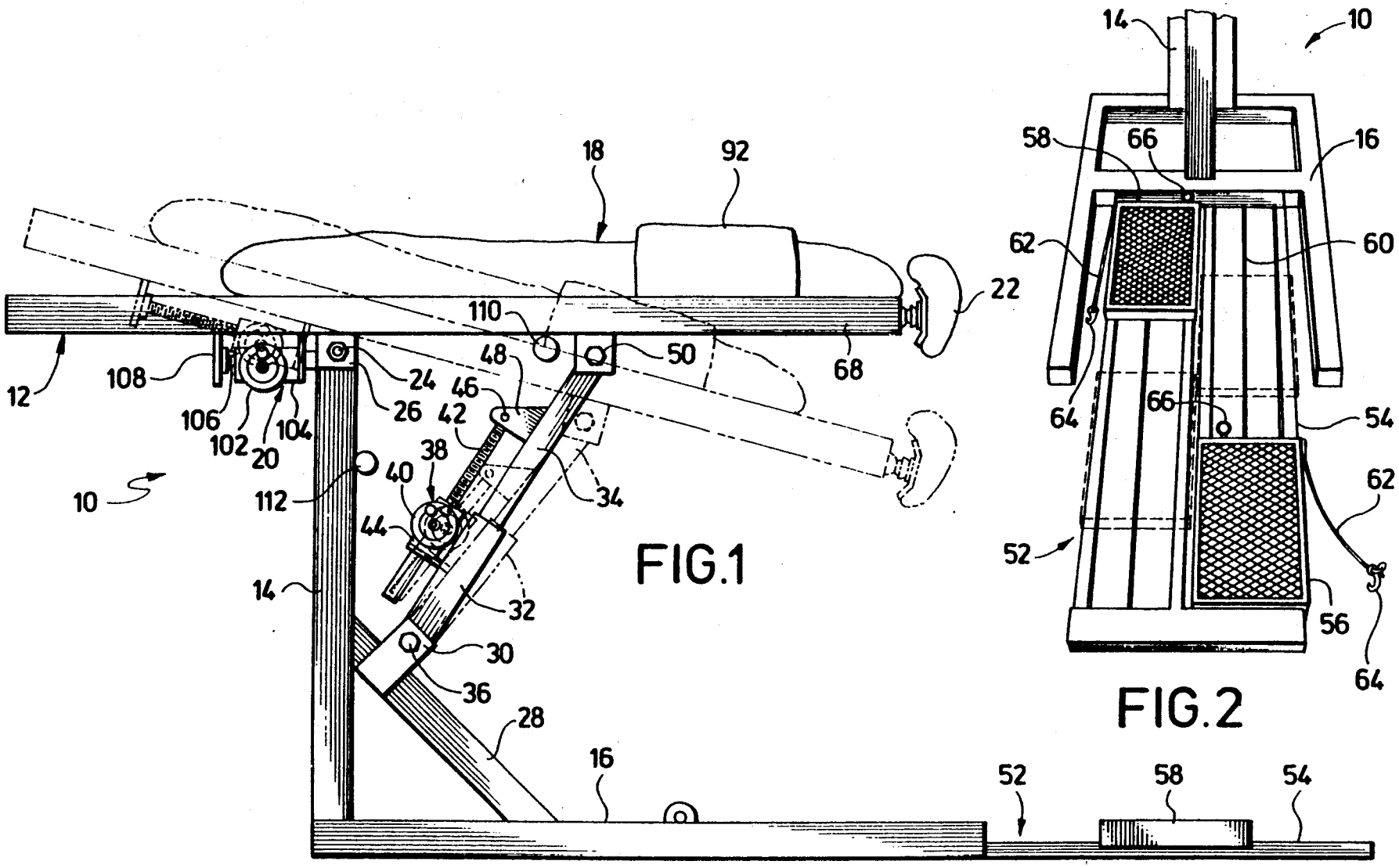
FIG. 1 is a side elevational view of the vertical lumbar traction device in accordance with the present invention, showing in phantom the elevated frame pivoted downwardly and the movable sled shifted relative to the frame.
FIG. 2 is a fragmentary perspective view of the pedestal and track unit of the present invention, showing the interconnected pedals in their extended position, and in phantom in an intermediate position.

Referring now to the drawing, an ambulatory lumbar traction device 10 in accordance with the present invention broadly includes the frame 12 pivotally mounted on an upright support member 14 which is in turn connected to and supported by base 16. Frame 12 slidably mounts a sled 18 thereon, the frame 12 and the sled 18 being interconnected by drive unit 20. An abutment pad 22 is pivotally mounted to the frame 12 and is adapted for engagement with the pelvic region of a patient during use of the ambulatory lumbar traction device 10.

In greater detail, the frame 12 of lumbar traction device 22 is preferably constructed of steel or other durable material. Frame 12 is elevated with respect to a supporting surface on which base 16 rests, in order that a patient may attain easy access in mounting and dismounting the device 10 hereof. To that end, a cross bolt 24 extends transversely through upright support member 14 and through brackets 26 depending from frame 12 to enable frame 12 to pivot relative to support member 14.

Base 16 and upright support member 14 are also interconnected by brace 28, which provides strength and support to the upright support member 14. A clamp 30 is attached to the upper end of the brace 28 and pivotally mounts a cylinder 32 and arm 34 thereon. Arm 34 is free to move axially into and out of cylinder 32, and preferably cylinder 32 and arm 34 comprise a dashpot such that arm 34 may not rapidly collapse into cylinder 32. A pin 36 connects the cylinder 32 to the clamp 30 enabling the axially shiftable arm 34 and cylinder to pivot thereabout.

Cylinder 32 and arm 34 are also interconnected by height adjustment member is 38 similar to drive member 20, and both are preferably manually actuated, worm gear drive actuators. Height adjustment member 38 includes a rotatable crank 40 and an extensible screw 42, as well as actuator 44. Actuator 44 is fixed to cylinder 32 while extensible screw is connected by fastener 36 to gusset 48 connected to arm 34. Arm 34 is also pivotally connected to frame 12 by bolt 50, as shown in FIG. 1.

Turning now to FIG. 2, a platform assembly 52 is located adjacent base 16 to enable ambulatory movement of the patient during therapy. Platform assembly 52 includes a track 54 carrying a pair of interconnected pedals 56 and 58 thereon. The pedals are mounted on rollers or wheels in order to enable them to freely move back and forth along the track, and are interconnected by a webbing strap 60 extending around pulleys located at each end of the track 54. Pedals 56 and 58 are oriented so that a patient may place one foot on each pedal 56 and 58, respectively, and move the pedals 56 and 58 in opposite directions Inasmuch as pedals 56 and 58 are interconnected by webbing 60, movement by a patient of one of the pedals rearwardly produces responsive movement of the other of said pedals in a forward direction, as shown in phantom in FIG. 2.

Each pedal 56 and 58 is provided with an attachment strap 62 connected to the respective pedal 56 or 58. Straps 62 serve to hold the patient's foot in position relative to each respective pedal, and are provided with a clip 64 for attachment to a catch 66 as shown in FIG. 2.

Figure 3:
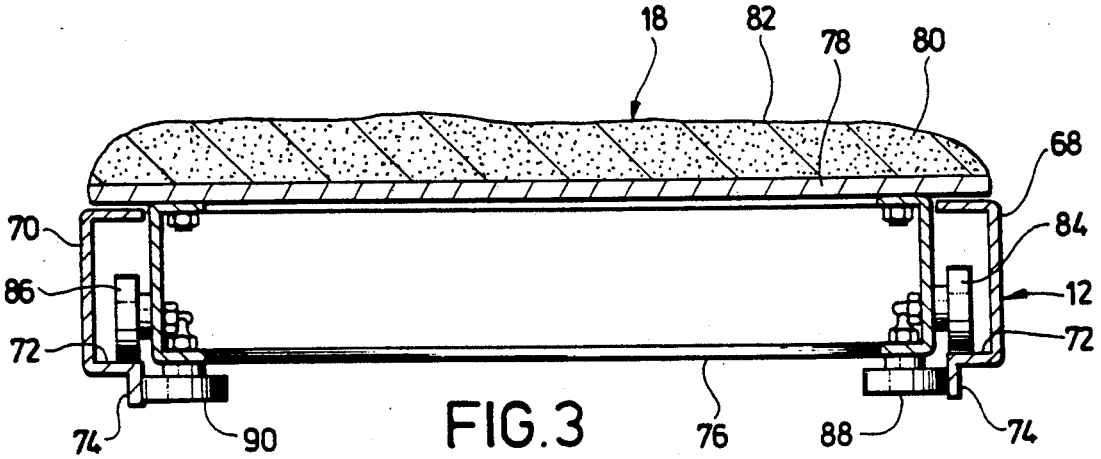
FIG. 3 is an enlarged horizontal sectional view taken transversely through the frame and sled of the present invention showing the vertically and horizontally oriented wheels for enabling shifting of the sled relative to the frame.

Turning now to FIG. 3, frame 12 includes channel members 68 and 70 extending along the sides thereof. Each channel 68, 70 includes a raceway 72 and a depending flange 74. Sled 18 is mounted on the frame 12 and shiftable therealong.

Sled 18 broadly includes framework element 76 which is located interior to frame 12 and to which is bolted a conventional cushion comprising a board 78, resilient padding 80 and cover 82.

Sled 18 is shiftable along frame 12 as sled 18 is provided with vertically oriented wheels 84 and 86 on axles at each end of the framework element 76 for movement along raceway 72, and horizontally oriented wheels 88 and 90 which are also rotatably mounted on axles located at each end of framework element 76. Horizontally oriented wheels 88 and 90 are oriented in engagement with the depending flange 74 of each channel 68, 70, whereby framework 76 and thus sled 18 is maintained in alignment during its reciprocal shifting along frame 12. Vertically oriented wheels 84 and 86 are rotatably mounted on framework element 76 at each end thereof whereby the weight of the torso of the patient carried by the sled is transferred to the raceway 72 along each channel member 68, 70. It is to be understood that framework 76 is provided with a pair of wheels 84, 88 and a second pair of wheels 86, 90 adjacent that end of framework element 76 corresponding to the patient's head, and another of each of said pairs is located adjacent the "pelvic" end of said framework element 76 of said sled 18..

Returning now to FIG. 1, it may be seen that a belt 92 is provided for releasably holding or binding the patient to the sled 18. A two-part belt 92 is made of resilient, elastic material and preferably provided at each opposing end with hook and pile closure material for connecting to itself when it is wrapped around the torso of a patient. One end of each part of the belt is thus attached by staples, upholstery tacks, adhesive or other conventional fastening means to board 78, with each opposing end providing the respective loop or pile fastener 122 adapted to meet the midway point above the sled 18. Because the belt 92 is made of resilient, elastic material such as rubber and cloth, it serves to bind the torso of the patient to the sled 18 when stretched over the back of a prone patient and the hook and pile fasteners 122 are interconnected.

Figure 4:
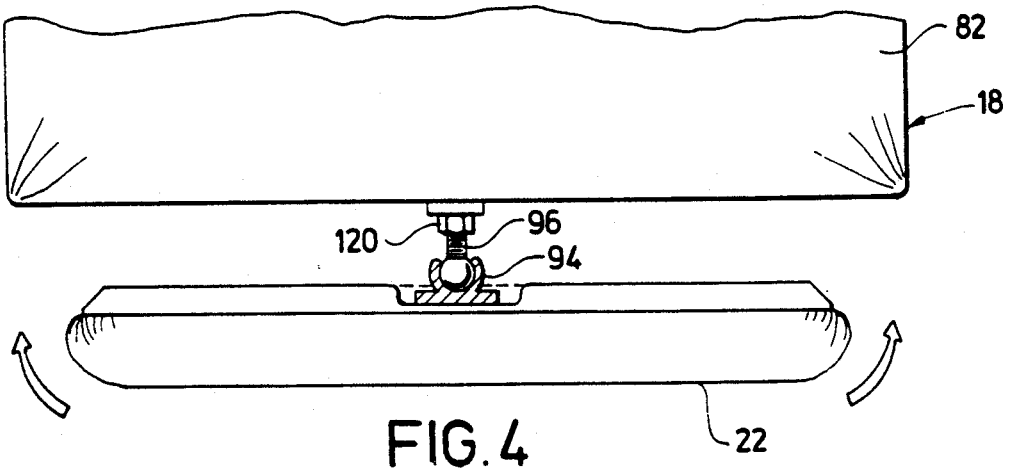
FIG. 4 is an enlarged, fragmentary top plan view of the abutment pad of the present invention with a portion removed to show the ball and socket joint pivotally mounting the abutment pad to the frame for side to side movement of the abutment pad.
Figure 5:
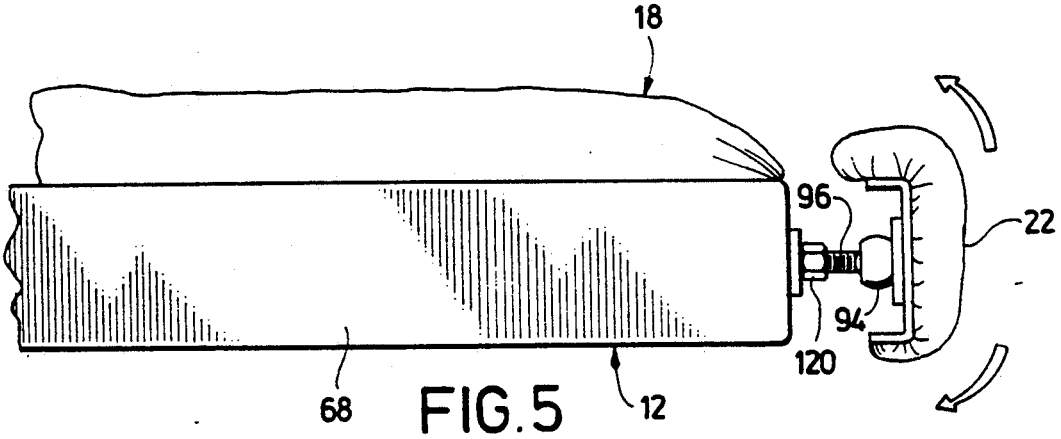
FIG. 5 is an enlarged, fragmentary left side elevational view of the abutment pad, frame and sled of the present invention showing the ball and socket joint pivotally mounting the abutment pad for enabling up and down movement of the abutment pad.

As may be seen in FIG. 4, abutment pad 22 is provided with a ball and socket joint 94 spaced outwardly from the end of frame 12 whereby the abutment pad 22 is free to pivot in either of two orthogonal directions. Threaded rod 96 to which ball and socket joint 94 is connected spaces abutment pad 22 outwardly a sufficient distance to prevent significant pivoting of abutment pad 22 in a horizontal plane, while, as shown in FIG. 5, abutment pad 22 is free to pivot in a substantially vertical plane around ball and socket joint 94, as well as rotate about a horizontal axis.

Figure 6:
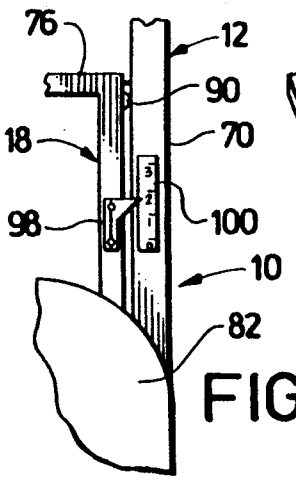
FIG. 6 is an enlarged, fragmentary top plan view of the sled and frame showing an indicator and scale for enabling the patient to gauge the degree of traction applied.

Turning now to FIG. 6, sled 18 is provided with an indicator 98 mounted on framework element 76. Apparatus 10 hereof is also provided with a scale 100 mounted on channel member 70 of frame 12 and juxtaposed to indicator 98. During axial movement of sled 18 along frame 12, indicator 98 points to a respective location on scale 100 whereby the patient may observe the amount of traction being employed. Preferably, indicator 98 is slidably mounted along framework element 76 so that each successive patient may "zero" the indicator at the beginning of his or her therapy session.

Returning now to FIG. 1, drive unit 20 is similar to height adjustment member 38, and includes a rotatable crank 102 and actuator drive unit 104 and an extensible screw 106. The actuator drive unit is fixed by welding or bolting to the frame and the extensible screw is provided with a distal mounting 108 belted or welded to the sled 18 whereby rotation of the crank 102 rotates a worm gear within actuator drive unit 104 to extend the screw 106 and cause sled 18 to move axially along frame 12. The crank 102 may be rotated in an either clockwise or counterclockwise direction to produce extension or retraction of the screw 106.

In addition, for ease in mounting and dismounting the ambulatory lumbar device hereof, handles 110 and bars 112 extend laterally from the device 10. As shown in FIG. 10, handles 110 are attached to the frame 12 and are somewhat elevated with respect to bars 112 mounted to upright support member 14.

Figure 8:
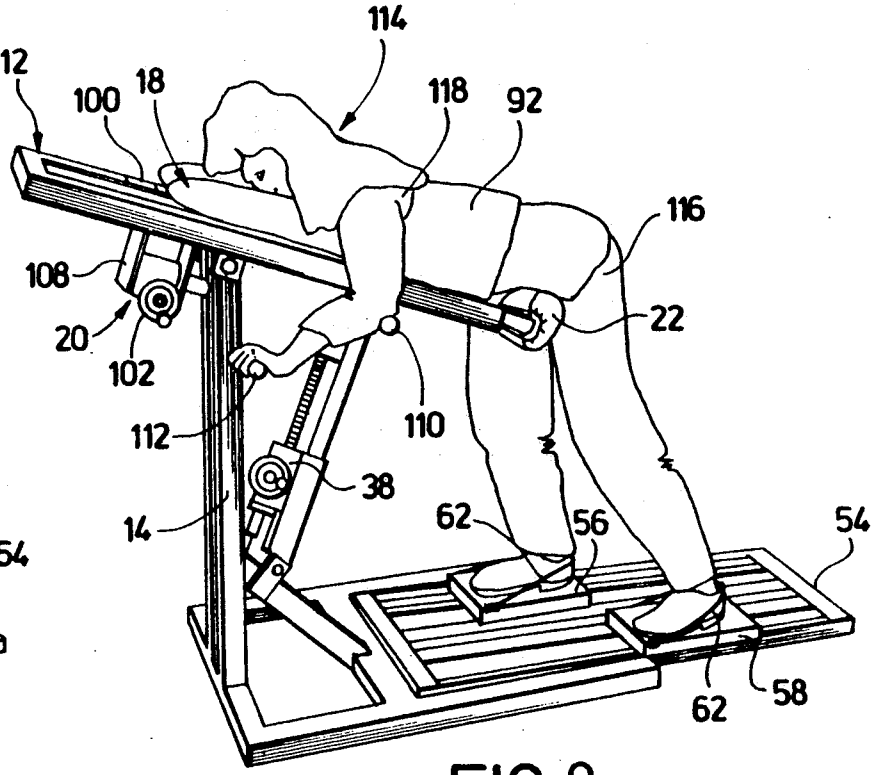
FIG. 8 is a perspective view of the present invention similar to FIG. 7 showing the patient with the belt tightened around her torso and initiating ambulatory movement of the pedals along the track.
Figure 7:
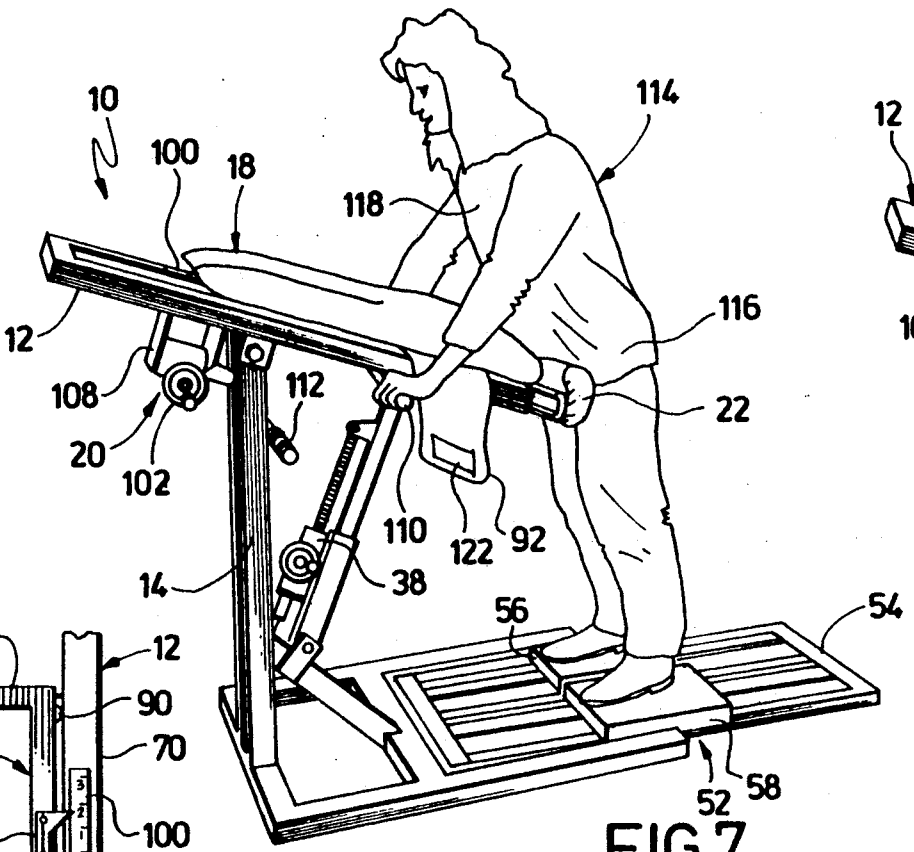
FIG. 7 is a perspective view of the present invention showing a patient standing on the platform preparing to lower her torso onto the sled.

Turning now to FIGS. 7 and 8, the ambulatory lumbar traction device may be used by patient 114 having either short or long legs, or a short or long torso. Height adjustment member 38 may be utilized to position the abutment pad 22 in the pelvic region 116 of the patient 114 whereby the patient's torso 118 may rest upon the sled 18. As may be seen in FIGS. 4 and 5, the threaded rod 96 may be moved inwardly or outwardly by nut 120 to compensate for the length of the patient's torso. In addition, further adjustment may be accomplished by rotating crank 102 of drive unit 20 to place the sled 18 in an appropriate starting position relative to the frame 12.

After the patient has pivoted the frame and the sled carried thereon to an appropriate position to place the abutment pad 22 adjacent his or her pelvic region 116, the patient may step onto the platform assembly 52, placing his or her feet on the pedals 56 and 58. The patient then attaches the clip 64 on the strap 62 to the catch 66 to hold each foot in position during the shifting of the pedals along the track 54. The patient then grasps handles 110, as shown in FIG. 7, to lower herself down with her chest on the sled 18. Bars 112 are also useful to enable the patient to gradually lower himself or herself down into the therapy position.

Therafter, a patient or an attendant, if necessary, may wrap the elastic belt 92 tightly around the waist portion of the patient's torso 118 to bind the patient onto the sled 118. A hook and pile attachment 122, such as that sold under the trademark Velcro serves to fasten the two portions of the elastic belt together. Prior to initiating traction, the patient preferably moves the indicator 98 to the zero position on the scale 100 in order to measure the amount of traction applied.

As shown in FIG. 8, the patient assumes a partially prone position whereby the torso 118 is supported by the sled 18. In this position, the patient 114 is oriented so that his or her arms may reach the crank 102 to apply a degree of traction to the lumbar spinal region. This may be accomplished as the sled 18 moves forwardly on the frame 12. As the sled 18 moves forwardly in response to rotation of the crank 102 and corresponding movement of the extensible screw 106, belt 92 urges the patient's torso 118 forward thereby applying traction to the lumbar region, inasmuch as the patient's pelvic region 116 lies in abutment with abutment pad 22.

The application of traction may be intermittent, such that the patient may rotate crank 102 only when he or she feels that additional traction is desirable or comfortable. Thus, the patient may apply a small increment of traction by rotating crank 102 slightly, followed by an interval of rest. During this interval, it is especially beneficial if the patient moves his or her feet and thus pedals 58 and 56 back and forth on track 54 whereby the patient's hips may pivot in a simulated ambulatory motion. Abutment pad 22 is free to swivel up and down and back and forth during the motion of the patient's feet back and forth on the track 54, thus permitting the ambulatory lumbar traction device 10 to be used in complete comfort.

When the patient desires to end the therapy session, he or she merely rotates crank 102 in the opposite direction in order to relieve the traction applied by the sled 18 and belt 92. Once all traction has been relieved and the indicator 98 returns to the zero position, the belt 92 is released, and the patient may stand up by using his or her arm muscles on handles 110 and bars 112 to come to an upright position. Thus, the patient may cease the intitiation of traction at any point, and may limit the amount of traction to be applied to that which is comfortable.

Having thus described my invention, it may be apparent to those skilled in the art that many minor modifications and variations in the apparatus and the method of using it may be employed without departing from the spirit of the invention. The above-referenced descrip-tion sets forth only the preferred embodiment of my invention, and not the entire scope thereof.

Having thus set forth the specifics of my invention, I claim:

1. A traction device for use by a patient to relieve lumbar discomfort comprising:

an elevated frame;

sled means shiftably mounted on said frame for supporting the torso of a patient;

coupling means carried by said sled means for releasably binding said patient's torso to said sled;

drive means for axially shifting said sled means relative to said frame; and abutment means pivotally mounted on said frame for engaging the pelvic region of said patient and for enabling pivotal movement of said pelvic region relative to said torso during shifting of said torso on said frame, whereby the patient may actuate said drive means to provide traction to the torso during pivoting of the pelvic region in engagement with said abutment means.

2. A traction device as set forth in claim 1, wherein said frame is pivotally mounted on a support member for adjusting the elevation of said abutment means.

3. A traction device as set forth in claim 2, including selectively actuatable drive means for adjusting the height of said abutment means.

4. A traction device as set forth in claim 1, wherein said abutment means is movable in at least two orthogonal directions.

5. A traction device as set forth in claim 4, wherein said abutment means comprises a ball and socket joint.

6. A traction device as set forth in claim 1, wherein said drive means is oriented for selected actuation by said patient when the torso of said patient is bound to said sled.

7. A traction device as set forth in claim 6, wherein said drive means is powered by said patient.

8. A traction device as set forth in claim 1, wherein said coupling means comprises a resilient belt for positioning in looping arragement around said torso.

9. A traction device as set forth in claim 1, including platform means for carrying the feet of said patient and for enabling reciprocal movement of said feet when the torso of said patient is bound to said sled.

10. A traction device as set forth in claim 9, wherein said platform means comprises means for simultaneous movement of the feet of said patient in opposite directions.

11. A traction device as set forth in claim 10, wherein said platform means comprises a track mounting a pair of interconnected foot platforms reciprocally shiftable along said track.

12. A traction device as set forth in claim 11, said foot platforms having means for releasably securing the feet of said patient thereto.

13. A traction device for use by a patient to relieve lumbar discomfort comprising:

a support member;

a frame pivotally mounted to said support member;

a sled shiftably mounted to said frame;

drive means interconnecting said sled and said frame for enabling axial movement of said sled along said frame;

means for coupling the torso of said patient to said sled; and foot platform means for movably carrying the feet of said patient when the torso of the patient is bound to said sled, whereby the patient may shift his or her feet on the foot platforms during the application of tractional force by movement of the sled along said frame.

14. A traction device as set forth in claim 13, wherein said foot platform means are interconnected for simultaneous movement in opposite directions according to input imparted to said foot platform means by the patient's feet.

15. A traction device as set forth in claim 14, wherein said pedal means are oriented for shifting in a normally horizontal plane.

* * * * *